United States Patent [19]

Burge

[11] Patent Number: 4,936,803

[45] Date of Patent: Jun. 26, 1990

[54] PROPELLER ASSEMBLY

[76] Inventor: Carvie O. Burge, 1160 E. Broadway, El Cajon, Calif. 92021

[21] Appl. No.: 270,236

[22] Filed: Nov. 14, 1988

[51] Int. Cl.[5] ..... B63H 11/08

[52] U.S. Cl. ..... 440/66; 415/185; 415/213 C; 440/38

[58] Field of Search ..... 440/66, 67, 38, 47; 114/151; 60/221; 415/182, 185, 213 C

[56] References Cited

U.S. PATENT DOCUMENTS

| | | | |
|---|---|---|---|
| 1,065,089 | 6/1913 | Wabo | 440/67 |
| 3,112,610 | 12/1963 | Jerger | 60/221 |
| 3,249,058 | 5/1966 | Parsons | 60/221 |

FOREIGN PATENT DOCUMENTS

| | | | |
|---|---|---|---|
| 51891 | 3/1910 | Sweden | 440/38 |

*Primary Examiner*—Sherman D. Basinger
*Assistant Examiner*—Edwin L. Swinehart
*Attorney, Agent, or Firm*—Ralph S. Branscomb

[57] ABSTRACT

A boat or ship's propeller system utilizes a rotary propeller comprised of a plurality of short blade elements arranged annularly and supported from a central propeller shaft by spokes, there being an annular "funnel" with the large end forward which scoops water and delivers it under some pressure to the rotating annular ring of blade elements.

1 Claim, 1 Drawing Sheet

PROPELLER ASSEMBLY

BACKGROUND OF THE INVENTION

The invention is in the field of marine propulsion mechanisms, and specifically pertains to submerged propeller drive mechanisms.

A typical ship's propeller is fairly inefficient. Whereas most of the forward thrust generated by the propeller is derived from the movement of the extremities of the propeller blades through the water, inasmuch as this region of the propeller is moving much faster than the rest, nonetheless the major portion of the blade structure is comprised of radially inner blade regions which do not generate nearly as much thrust as the extremities.

Because the entire length of the blade is used for thrust in most propellers, and because the pitch of the blade elements is dependent not only upon its speed, which in turn depends on its radial distance from its axis of rotation, but also the axial distance from the propeller's leading edge, the blade must be made in a fairly complex configuration with carefully controlled contours. This requirement causes blades to be rather expensive. This expense in creating the entire blade such that it strikes the water at every point at the optimal angle for delivering thrust may not be justified in view of the fact that the major portion of the blade delivers relatively little thrust. In other words, if only the outer perimeter were properly contoured and the inner blade portions were omitted entirely, not a lot of thrust would be lost.

Another built-in inefficiency of the conventional propeller lies in the fact of cavitation. As the blade rotates and thrusts water rearwardly, it is expelling water faster than water is being replenished from the front of the propeller, causing vacuums to exist in front and at the sides of the propeller. The fact of cavitation considerably decreases the efficiency and the effectiveness of conventional propellers. If cavitation could be reduced and even eliminated, the result would be a noticeable increase in power and efficiency.

There is a need, therefore, for a submersible propeller blade which operates on an annular portion of the periphery of the propeller rather than the entire circular area circumscribed by the rotating propeller, and that makes provision to avoid cavitation.

SUMMARY OF THE INVENTION

The instant invention fulfills the above-stated need by providing a fan-like propeller having no blades in the radially inner reaches of the propeller system, but having a peripheral annular ring of fan-like blade elements mounted between a pair of concentric cylindrical rings. The annular blade structure is in turn disposed immediately to the rear of an annular funnel, comprised of a pair of shrouds which converge toward the annular blade ring from the radial outer and inner direction, so that as the ship moves through the water, the annular funnel compresses water and delivers it under pressure to the annular blade ring, such that as the ring rotates, cavitation is reduced and probably even eliminated by virtue of the fact that the water immediately in front of the blade elements is under pressure, greatly reducing the ability of the rotating blade ring to cavitate.

DETAILED DESCRIPTION OF THE PREFERRED EMBODIMENT

Figure 1:
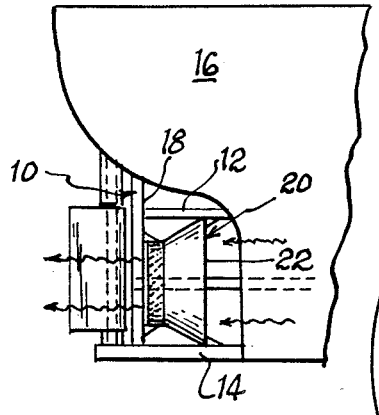
FIG. 1 is an illustration of the rear end of a ship illustrating the propeller assembly in action.
Figure 2:
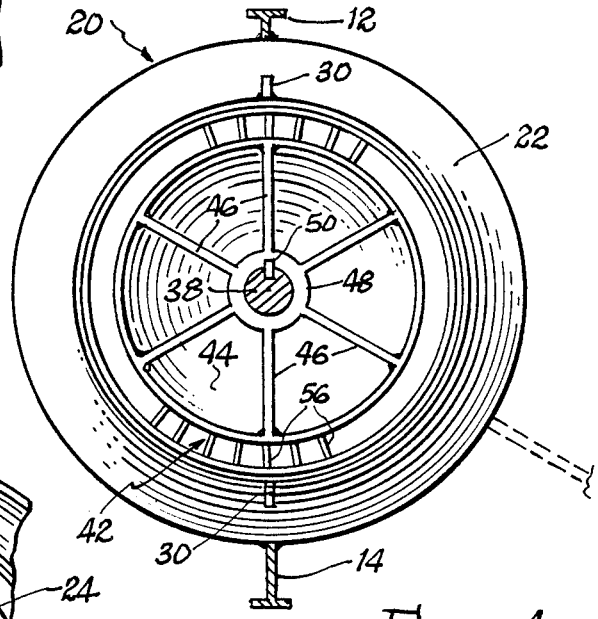
FIG. 2 is a rear elevation view of the propeller assembly taken along line 2—2 of FIG. 4.
Figure 3:
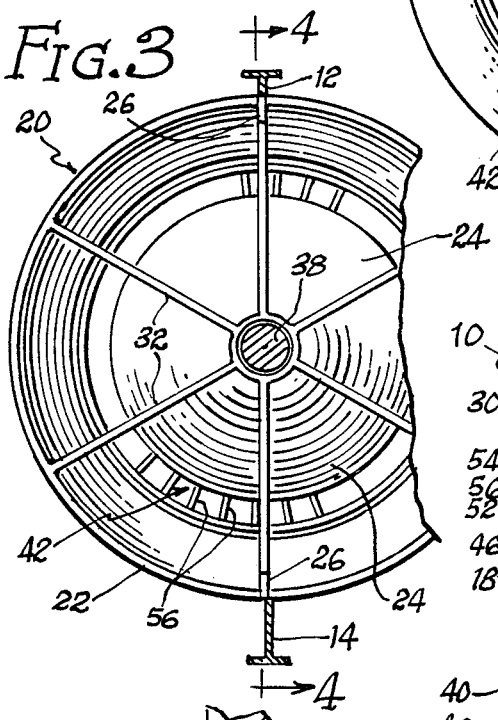
FIG. 3 is a front elevation view of the propeller assembly.

The propeller assembly is mounted on a framework 10 which in the illustrated embodiment comprises a pair of longitudinal beams 12 and 14 at the top and bottom of the propeller assembly. Clearly there could be two further longitudinal beams alongside the propeller assembly, or even more longitudinal structural members. The upper beam 12 extends from the body 16 of the ship and terminates in a vertical stanchion 18, and the stanchion in turn terminates at its lower end in the lower longitudinal beam 14.

This structure in turn mounts and supports the annular funnel 20, which has an outer shroud 22 and an inner shroud 24. The outer shroud is welded to the beams 12 and 14 by means of gussets 26, and at the rear end, the cylindrical flange portion 28 is similarly welded to the stanchion 18 by means of gussets 30. Thus far it can be seen how the outer shroud 22 is securely mounted into the framework 10 of the propeller assembly.

The inner shroud 24 is mounted to the outer shroud by means of fixed radial struts 32 at the forward end of the annular funnel, and an equal number of short gussets 34 at the rear end of the funnel. Thus the inner shroud is secured only to the outer shroud by forward and aft radial supports.

Figure 4:
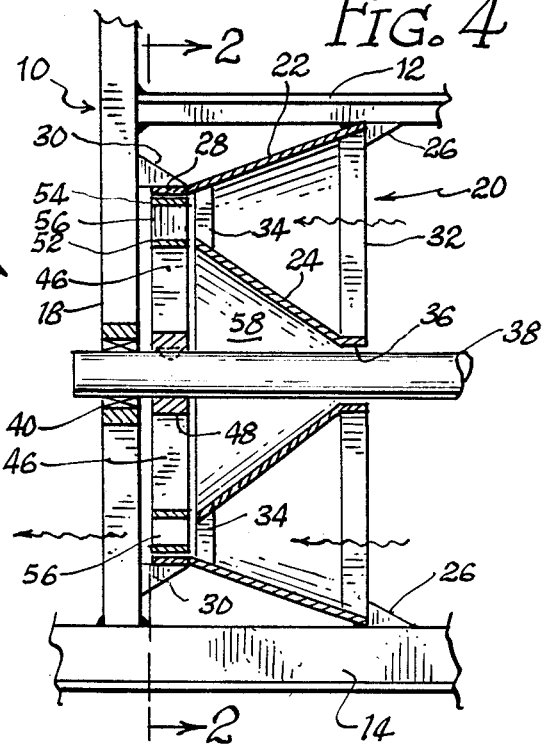
FIG. 4 is a section taken along line 4—4 of FIG. 3.
Figure 5:
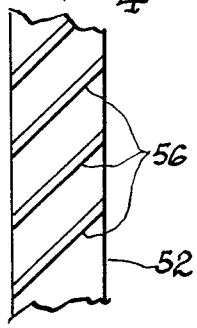
FIG. 5 is a fragmentary section taken across several blade elements illustrating the angle they strike with the cylindrical segments that contain them.

The inner edge of the inner shroud 24 defines a cylindrical opening 36 through which passes the propeller shaft 38. The shaft is journalled somewhere forward of the drawings in the interior of the ship, and at its rear end is journalled in a bearing 40 mounted in the stanchion 18. Thus, the shaft is free to rotate in the bearing, driven by whatever propulsive means is used in the ship forward of the apparatus as shown in FIG. 4, assuming that the system is shaft-driven. Because of the outer ring 54 around the annular blade element array, the propeller could actually be directly belt-driven as an alternative to the conventional shaft-driven system.

The actual rotary blade or propeller is shown at 42. Contrary to standard propeller construction, this propeller has a radially inner area 44 which is devoid of blade elements, and is provided with only radial spokes 46 which extend from an inner hub 48 which is keyed at 50 into the shaft, to the inner of two cylindrical rings 52 and 54. Between the inner and the outer rings 52 and 54 lie the angularly disposed blade elements 56 which comprise the propulsive elements of the system. The outer ring 54 could actually be omitted.

It will be noted that the annular array of the blade elements 56 is disposed immediately behind and in the flow path of the annular funnel 20, so that as the vessel moves through the water, water is compressed into the funnel, and delivered directly to the annular arrangement of blade elements. This pressurized water is consequently thrust rearwardly by the blade elements, but because of the compressing action of the funnel, the blade elements do not cavitate despite the fact that their rearward thrust velocity is quite high. The flange 28 actually extends to the rear edge of the propeller to further direct and confine the water stream.

The region 58 inside the inner shroud is a dead zone. Although there will be eddy currents and some rearward flow, nothing happens in this zone that is propulsive, or for that matter frictional.

Thus, the invention truly maximizes the effect of a particular angular velocity applied to the propeller, dispensing with the fairly frictional, and not particularly effective radially inner portion of the rotary blade, and maximizing the effectiveness of the outermost blade region by positioning it immediately behind an annular funnel. The annular funnel, as mentioned above, reduces or eliminates cavitation, and also provides higher pressure water for the blade elements. It is known that propellers operating in a higher pressure fluid are more efficient than propellers operating in a low pressure fluid. Thus, the entire assembly is a leap forward in the marine propulsion art, and maximizes the thrusting effect of a propeller assembly, while minimizing the drag.

I claim:

1. A propeller assembly comprising:

(a) a single rotary propeller with a plurality of blade elements angled to force water axially rearwardly as said propeller is rotated, said propeller being rotationally mounted in a frame structure;

(b) an annular funnel mounted in said frame structure and having a wide annular forward end tapering down to a narrow annular rearward end adjacent said blade elements such that as said funnel passes through the water it scoops in water and delivers it under pressure out the rearward end to said blade elements;

(c) wherein said blade elements being mounted between a pair of cylindrical rings and being arranged annularly behind the annular rearward end of said funnel, and the space radially inward of said annularly arranged blade elements is substantially open, and including a shaft mounting a plurality of support spokes extending radially outwardly therefrom to said annularly arranged blade elements to support same;

(d) said annular funnel being defined by an outer shroud and an inner shroud, and said outer shroud extends rearwardly past said blade element and terminating substantially at the rear edge thereof;

(e) said shaft extending coaxially of said shrouds and passing adjacent the inner edge of said inner shroud such that little water is admitted between said inner shroud and said shaft, said shaft being completely rotationally independent of said shrouds; and, (f) said outer shroud being continuously convergent from its forwardmost edge to its rearmost; and, (g) the radially measured widths of said blade elements being on the order of one third the overall radius of said propeller, and the axial depth of said blades being on the order of the radially-measured widths thereof.

* * * * *